US010883502B2

(12) United States Patent
Moon et al.

(10) Patent No.: US 10,883,502 B2
(45) Date of Patent: Jan. 5, 2021

(54) HERMETIC COMPRESSOR HAVING A VANE WITH GUIDE PORTION

(71) Applicant: LG ELECTRONICS INC., Seoul (KR)

(72) Inventors: Seokhwan Moon, Seoul (KR); Seoungmin Kang, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 283 days.

(21) Appl. No.: 15/876,304

(22) Filed: Jan. 22, 2018

(65) Prior Publication Data

US 2018/0223844 A1 Aug. 9, 2018

(30) Foreign Application Priority Data

Feb. 7, 2017 (KR) ..... KR10-2017-0016968

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 18/344*** | (2006.01) |
| ***F01C 21/08*** | (2006.01) |
| ***F04C 27/00*** | (2006.01) |
| ***F04C 29/12*** | (2006.01) |
| *F04C 23/00* | (2006.01) |

(52) U.S. Cl.

CPC ..... *F04C 18/3447* (2013.01); *F01C 21/0836* (2013.01); *F01C 21/0854* (2013.01); (Continued)

(58) Field of Classification Search

CPC ..... F04C 18/3442; F04C 18/3447; F04C 23/008; F04C 27/001; F04C 29/12; (Continued)

(56) References Cited

U.S. PATENT DOCUMENTS 1,743,539 A * 1/1930 Gasal ..... F01C 21/0836 418/265
4,653,991 A * 3/1987 Takao ..... F01C 21/0872 418/268

(Continued)

FOREIGN PATENT DOCUMENTS

CN 103080553 5/2013
CN 103906926 7/2014

(Continued)

OTHER PUBLICATIONS

European Search Report dated May 17, 2018.

(Continued)

*Primary Examiner* — Theresa Trieu
(74) *Attorney, Agent, or Firm* — Ked & Associates LLP

(57) ABSTRACT

A hermetic compressor is provided that may include a vane that is inserted into a roller, rotates with the roller, and is pushed out toward an inner circumference of a cylinder by rotation of the roller to divide the compression chamber into a plurality of spaces. The vane may include a body having a sealing surface that contacts the inner circumference of the cylinder and inserted into the roller; and a guide that extends from an axial end of the body in a direction crossing a direction the vane slides out, and that is slidably inserted into a guide groove formed on at least one of the first bearing or the second bearing to restrain the vane from sliding out of the roller toward the inner circumference of the cylinder.

19 Claims, 11 Drawing Sheets

(52) U.S. Cl.
CPC ..... *F04C 18/3442* (2013.01); *F04C 27/001* (2013.01); *F04C 29/12* (2013.01); *F04C 23/008* (2013.01); *F04C 2210/10* (2013.01); *F04C 2240/50* (2013.01)

(58) Field of Classification Search
CPC ..... F04C 2210/10; F04C 2240/50; F01C 21/0809; F01C 21/0836; F01C 21/0854
USPC ..... 418/184, 259, 266–268
See application file for complete search history.

(56) References Cited

U.S. PATENT DOCUMENTS

| | | | | |
|---|---|---|---|---|
| 6,036,462 | A | 3/2000 | Mallen | |
| 2008/0135012 | A1 | 6/2008 | Shuba | |
| 2014/0369878 | A1* | 12/2014 | Shimaguchi | F04C 29/12 418/15 |

FOREIGN PATENT DOCUMENTS

| | | |
|---|---|---|
| CN | 104040179 | 9/2014 |
| FR | 2 507 256 | 6/1982 |
| JP | 09-25885 | 1/1997 |
| JP | 2009-007937 | 1/2009 |
| WO | WO 2014/167708 | 10/2014 |
| WO | WO 2016/026556 | 2/2016 |
| WO | WO 2016/193043 | 12/2016 |

OTHER PUBLICATIONS

International Search Report dated May 21, 2018.
Chinese Office Action dated Apr. 14, 2020. (English Translation).

* cited by examiner

HERMETIC COMPRESSOR HAVING A VANE WITH GUIDE PORTION

CROSS-REFERENCE TO RELATED APPLICATION(S)

Pursuant to 35 U.S.C. § 119(a), this application claims the benefit of an earlier filing date of and the right of priority to Korean Application No. 10-2017-0016968, filed in Korea on Feb. 7, 2017, the contents of which are incorporated by reference herein in its entirety.

BACKGROUND

1. Field

A hermetic compressor is disclosed herein.

2. Background

A typical rotary compressor is a type of compressor in which a roller and a vane come into contact with each other and a compression space of a cylinder is divided into an intake chamber and an exhaust chamber with respect to the vane. In such a typical rotary compressor (hereinafter, interchangeably referred to as "a rotary compressor"), the vane moves linearly as the roller rotates, and therefore, the intake chamber and the exhaust chamber form a volume-variable compression chamber to suction, compress, and expel refrigerant.

As opposed to such a rotary compressor, a vane rotary compressor is also known in which a vane is inserted into a roller and rotates with the roller to form a compression chamber as it is pushed out by centrifugal force and back pressure. Such a vane rotary compressor has an increase in friction loss compared with the typical rotary compressor because, usually, as a plurality of vanes rotate with a roller, sealing surfaces of the vanes slide keeping contact with an inner circumference of the cylinder.

The inner circumference of the cylinder of such a vane rotary compressor is circular, whereas, recently, there has been introduced a vane rotary compressor with a so-called hybrid cylinder (hereinafter, "hybrid rotary compressor") in which the inner circumference of the cylinder has an elliptical shape to reduce friction loss and improve compression efficiency.

FIG. 1 is a transverse cross-sectional view of a compression section of a conventional vane rotary compressor.

As shown in the figure, inner circumference 1*a* of a conventional hybrid cylinder 1 has a shape of a so-called symmetrical elliptical cylinder, which is symmetrical with respect to a first centerline L1 passing through a position of proximity (hereinafter, abbreviated as "first contact point") between the inner circumference 1*a* of the cylinder 1 and outer circumference 2*a* of a roller 2 and center Oc of the cylinder 1, and which is symmetrical with respect to a second centerline L2 crossing the first centerline L1 at right angles and passing through the center Oc of the cylinder 1.

Moreover, the outer circumference 2*a* of the roller 2 is circular, and a plurality of vane slots 21 is formed in a circumferential direction on the outer circumference 2*a* of the roller 2. Each individual vane 4 is slidably inserted into the vane slots 21 to divide a compression space in the cylinder 1 into a plurality of compression chambers 11*a*, 11*b*, and 11*c*.

A back pressure chamber 22 is formed at an inner end of the vane slot 21 corresponding to a back pressure surface 4*b* of each vane 4 to admit an oil (or refrigerant) toward the back pressure surface 4*b* of the vane 4 and apply pressure to each vane 4 toward the inner circumference 1*a* of the cylinder 1. Thus, when the roller 2 rotates, the vane 4 is pushed out by centrifugal force and back pressure and comes into contact with the inner circumference 1*a* of the cylinder 1, and contact point P2 between the vane 4 and the cylinder 1 moves along the inner circumference 1*a* of the cylinder 1.

In addition, an intake port 12 and exhaust ports 13 are respectively formed on one side and the other side of the inner circumference 1*a* of the cylinder 1 with respect to first contact point P1 between the cylinder 1 and the roller 2.

The vane rotary compressor has a shorter compression cycle than a typical rotary compressor due to its nature, which may cause over-compression, and this over-compression may lead to compression loss. Accordingly, the conventional cylinder 1 has a plurality of exhaust ports 13*a* and 13*b* formed along a compression path (a direction of compression) to sequentially expel part of compressed refrigerant, thereby solving the problem of over-compression. Among these exhaust ports 13*a* and 13*b*, the exhaust port positioned upstream from the compression path is called a sub exhaust port (or first exhaust port) 13*a* and the exhaust port positioned downstream is called a main exhaust port (or second exhaust port) 13*b*, and exhaust valves 51 and 52 are respectively installed on an outside of the exhaust ports 13*a* and 13*b*.

However, the above conventional vane rotary compressor has the problem of increased mechanical friction loss between the cylinder 1 and the vane 4 as the inner circumference 1*a* of the cylinder 1 and sealing surface 4*a* of the vane 4 are always in contact with each other or move relative to each other in close proximity, with an oil film between them.

Another problem of the conventional vane rotary compressor is that, as the inner circumference 1*a* of the cylinder 1 and the sealing surface 4*a* of the vane 4 make contact with each other, a radius associated with linear velocity is lengthened and the linear velocity increases, leading to increased mechanical friction loss. Yet another problem of the conventional vane rotary compressor is that the contact force of the vane, that is, the vane force of contact with the cylinder 1, is high in some part of an entire range where the cylinder 1 and the vane 4 move keeping contact with each other, thus causing high mechanical friction loss, whereas the contact force of the vane is low in the other part and therefore refrigerant leakage occurs.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a vane rotary compressor according to an embodiment will be described with reference to the accompanying drawings. Where possible, like references have been used to indicate like elements and repetitive disclosure has been omitted.

Figure 1:
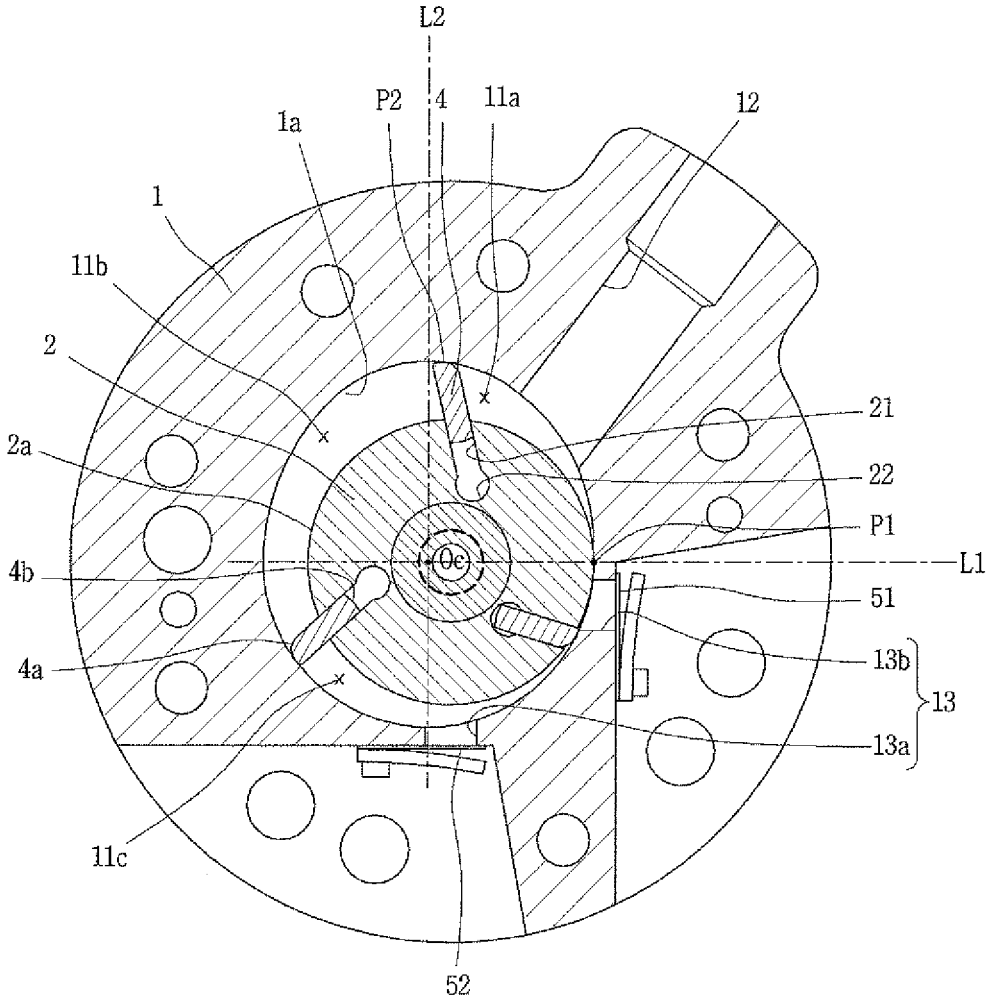
FIG. 1 CONVENTIONAL ART
FIG. 1 is a transverse cross-sectional view of a conventional vane rotary compressor.
Figure 2:
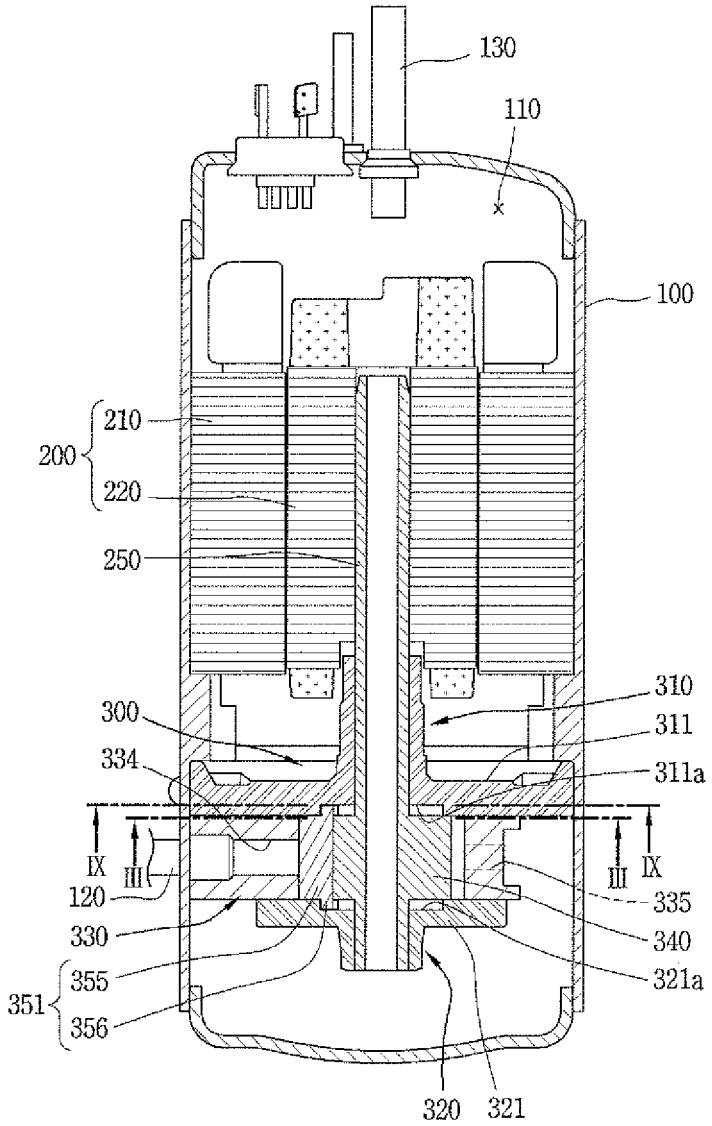
FIG. 2 is a vertical cross-sectional view of a vane rotary compressor according to an embodiment.
Figure 3:
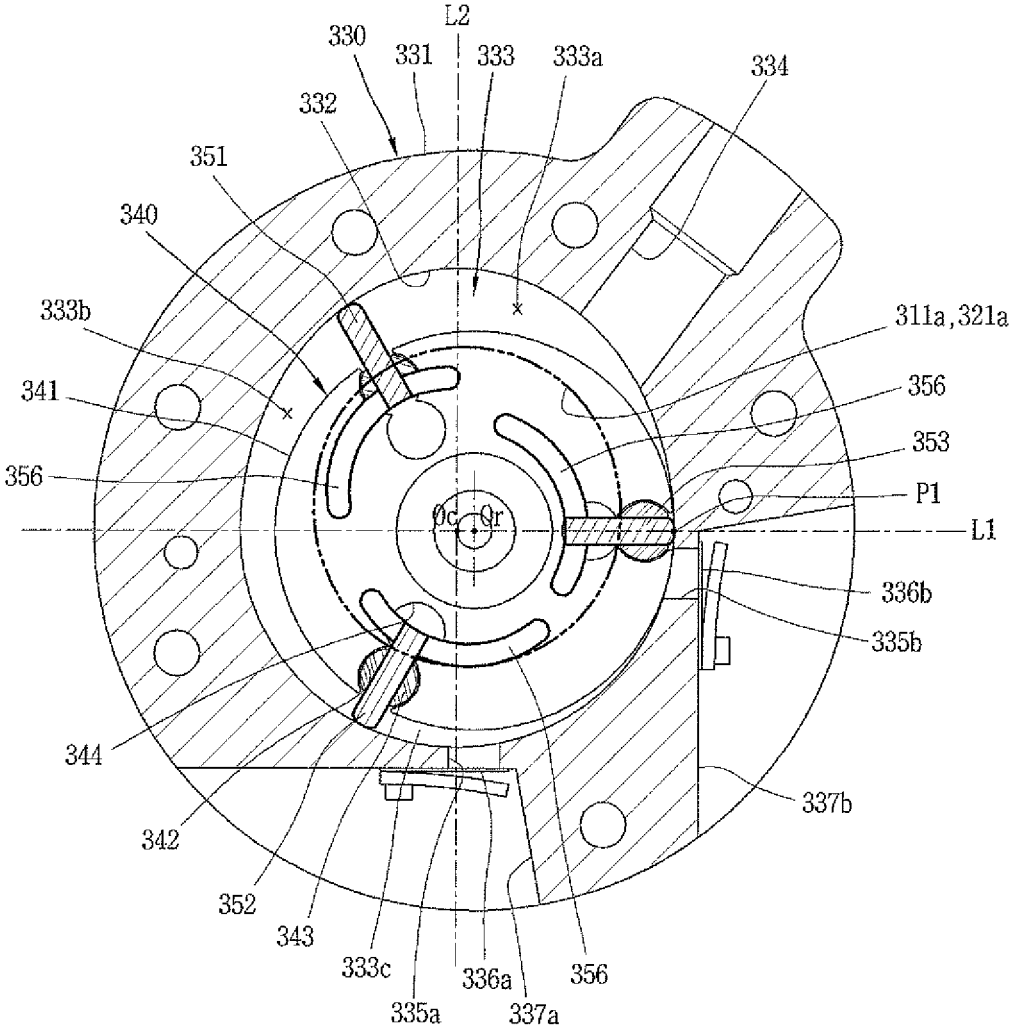
FIG. 3 is a cross-sectional view taken along "III-III" of a compression section in the vane rotary compressor of FIG. 2.

FIG. 2 is a vertical cross-sectional view of a vane rotary compressor according to an embodiment. FIG. 3 is a cross-sectional view taken along "III-III" of a compression section in the vane rotary compressor of FIG. 2.

As shown in FIG. 2, in the vane rotary compressor according to an embodiment, a motor section or motor 200 may be installed inside a casing 100, and a compression section 300 to be mechanically connected by a rotary shaft 250 may be installed on one side of the motor section 200. The casing 100 may be divided in a vertical or transverse direction or vertically or transversely depending on how the compressor is installed. When the casing 100 is divided vertically, the motor section and the compression section may be respectively arranged in or at upper and lower sides along an axis, and when the casing 100 is divided transversely, the motor section and the compression section may be respectively arranged in or at left and right or lateral sides.

The compression section 300 may include a cylinder 330 with a compression space 333 formed in it by a main bearing 310 and sub bearing 320 respectively installed on or at both sides of the axis. An inner circumference of the cylinder 330 according to this embodiment may be elliptical, rather than circular. The cylinder 330 may have a shape of a symmetrical ellipse with a pair of long and short axes or have a shape of an asymmetrical ellipse with multiple pairs of long and short axes. Such an asymmetrical elliptical cylinder is commonly called a hybrid cylinder, and this embodiment relates to a vane rotary compressor using a hybrid cylinder.

As shown in FIGS. 2 and 3, outer circumference 331 of the hybrid cylinder (hereinafter, abbreviated as "cylinder") 330 according to this embodiment may be circular, or may be non-circular as long as it is fixed to an inner circumference of the casing 100. The main bearing 310 or sub bearing 320 may be fixed to the inner circumference of the casing 100, and the cylinder 330 may be fastened with a bolt to the bearing fixed to the casing 100.

An empty space area may be formed in or at a center of the cylinder 330 to form a compression space 333 including inner circumference 332. This empty space area is sealed by the main bearing 310 and the sub bearing 320 to form the compression space 333. A roller 340, which is described hereinafter, is rotatably attached to the compression space 333.

The inner circumference 332 of the cylinder 330 forming the compression space 333 may include a plurality of circles. For example, if a line passing through a point (hereinafter, "first contact point") P1 where the inner circumference 332 of the cylinder 330 and outer circumference 341 of the roller 340 are nearly in contact with each other and a center Oc of the cylinder 330 is referred to as a first centerline L1, one side (upper side in the drawing) of the first centerline L1 may be elliptical, and the other side (lower side in the drawing) may be circular.

Also, if a line crossing the first centerline L1 at right angles and passing through the center Oc of the cylinder 330 is referred to as a second centerline L2, two opposite sides (left and right or lateral sides in the drawing) of the inner circumference 332 of the cylinder 330 may be symmetrical with respect to the second centerline L2. That is, the left and right sides may be asymmetrical.

On the inner circumference 332 of the cylinder 330 are an intake port 334 and exhaust ports 335*a* and 335*b* which may be formed on two opposite sides of the circumference with respect to the point where the inner circumference 332 of the cylinder 330 and the outer circumference 341 of the roller 340 are nearly in contact with each other. An intake pipe 120 penetrating the casing 100 may be directly connected to the intake port 334, and the exhaust ports 335*a* and 335*b* may communicate with an internal space 110 in the casing 100 and be indirectly connected to an exhaust pipe 130 attached to and penetrating the casing 100. Thus, refrigerant may be suctioned directly into the compression space 333 through the intake port 334, whereas compressed refrigerant is expelled into the internal space 110 in the casing 100 through the exhaust ports 335*a* and 335*b* and then released to the exhaust pipe 130. Accordingly, the internal space 110 of the casing 100 may be maintained at a high pressure which is a discharge pressure.

Moreover, while the intake port 334 has no intake valve, the exhaust ports 335*a* and 335*b* have exhaust valves 336*a* and 336*b* installed in them to open or close the exhaust ports 335*a* and 335*b*. The exhaust valves 336*a* may be reed valves, one or a first end of which is fixed and the other or a second end of which is a free end. Apart from the reed valves, piston valves, for example, may be used as the exhaust valves 336*a* and 336*b* as required.

In the case the exhaust valves 336*a* and 336*b* are reed valves, valve grooves 337*a* and 337*b* may be formed on the outer circumference 331 of the cylinder 330 so that the exhaust valves 336*a* and 336*b* are mounted on them. Accordingly, a length of the exhaust ports 335*a* and 335*b* may be reduced to a minimum, thereby reducing dead volume. The valve grooves 337*a* and 337*b* may have a triangular shape to ensure a flat valve sheet as in FIG. 3.

A plurality of exhaust ports 335*a* and 335*b* may be formed along a compression path (a direction of compression). For convenience, among the plurality of exhaust ports 335*a* and 335*b*, the exhaust port positioned upstream in the compression path is called a sub exhaust port (or first exhaust port) 335*a* and the exhaust port positioned downstream is called a main exhaust port (or second exhaust port) 335*b*.

However, the sub exhaust port is not an essential element and may be optionally provided as needed. For example, in this embodiment, in the case the inner circumference 332 of the cylinder 330 properly reduces over-compression of refrigerant by having a long compression cycle as described hereinafter, the sub exhaust port may not be provided. In order to reduce an amount of over-compression of compressed refrigerant to a minimum, the sub exhaust port 335*a* as in the conventional art may be provided in front of the main exhaust port 335*b*, that is, further upstream than the main exhaust port 335*b* with respect to the direction of compression.

The roller 340 may be rotatably provided in the compression space 333 of the cylinder 330. The outer circumference 341 of the roller 340 may be circular, and the rotary shaft 250 may be integrally attached to a center of the roller 340. As such, the roller 340 has a center Or that matches the center of the rotary shaft 350, and rotates with the rotary shaft 250 about the center Or of the roller 340.

Moreover, the center Or of the roller 340 is eccentric to the center Oc of the cylinder 330, that is, the center of the inner space in the cylinder 330, so one side of the outer circumference 341 of the roller 340 is nearly in contact with the inner circumference 332 of the cylinder 330. If the point on the cylinder 330 at which one side of the roller 340 is nearly in contact with the inner circumference 332 of the cylinder 330 is referred to as first contact point P1, the first contact point P1 on the first centerline L1 passing through the center of the cylinder 330 may correspond in position to the short axis of an elliptical curve forming the inner circumference 332 of the cylinder 330.

In addition, bushing grooves 342 may be formed in a circumferential direction at a proper number of positions on the outer circumference 341 of the roller 340, and a swing bushing 343 forming a kind of vane slot may be rotatably attached to each bushing groove 342. As the swing bushing 343, two approximately hemispherical bushings may be attached to each bushing groove 342 at an interval of a thickness of the vane 351, 352, and 353. Thus, the vane 351, 352, and 353 attached to the swing bushing 343 may rotate on the swing bushing 343 as a hinge point while moving along the inner circumference 332 of the cylinder 330.

A back pressure chamber 344 may be formed in a central part or portion of the roller 340, that is, between the bushing groove 342 to which the swing bushing 343 is attached and the rotary shaft 250, to admit oil (or refrigerant) toward a first back pressure surface of the vane 351, 352, and 353 and apply pressure to the vane 351, 352, and 353 toward the inner circumference 331 of the cylinder 330. The back pressure chamber 344 may be sealed by the main bearing 310 and the sub bearing 320. Each back pressure chamber 344 may individually communicate with a back pressure flow path (not shown), or a plurality of back pressure chambers 344 may communicate with the back pressure flow path.

If the first vane 351 is the closest vane to the first contact point P1 with respect to the direction of compression, then the second vane 352, and then the third vane 353, the first vane 351 and the second vane 352 are spaced apart from each other, the second vane 352 and the third vane 353 are spaced apart from each other, and the third vane 353 and the first vane 351 are spaced apart from each other, all at a same angle of circumference. Thus, assuming that the first vane 351 and the second vane 352 form a first compression chamber 333*a*, the second vane 352 and the third vane 353 form a second compression chamber 333*b*, and the third vane 353 and the first vane 351 form a third compression chamber 333*c*, all the compression chambers 333*a*, 333*b*, and 333*c* have a same volume at a same crank angle.

The vanes 351, 352, and 353 have a shape of an approximate cuboid. One of two longitudinal ends of each vane that makes contact with the inner circumference 332 of the cylinder 330 is referred to as a sealing surface 355*a* of the vane, and the other one facing the back pressure chamber 344 is referred to as a first back pressure surface 355*b*. The sealing surface 355*a* of the vane 351, 352, and 353 is curved to make linear contact with the inner circumference 332 of the cylinder 330, and the first back pressure surface 355*b* of the vane 351, 352, and 353 may be made flat so as to be inserted into the back pressure chamber 344 and receive uniform back pressure Fb.

In the drawings, unexplained reference numeral 210 denotes a stator, and unexplained reference numeral 220 denotes a rotor.

In a vane rotary compressor with the above hybrid cylinder, when power is applied to the motor section 200 and the rotor 220 of the motor section 200 and the rotary shaft 250 attached the rotor 220 rotate, the roller 340 rotates with the rotary shaft 250. Then, the vane 351, 352, and 353 is pushed out of the roller 340 by a centrifugal force Fc generated by rotation of the roller 340 and the back pressure Fb formed on the first back pressure surface 355*b* of the vane 351, 352, and 353, whereby the sealing surface 355*a* of the vane 351, 352, and 353 comes into contact with the inner circumference 332 of the cylinder 330.

Then, the vanes 351, 352, and 353 form as many compression chambers 332*a*, 332*b*, and 332*c* as the vanes 351, 352, and 353 in the compression space 333 in the cylinder 330. As each compression chamber 333*a*, 333*b*, and 333*c* moves along with the rotation of the roller 340, their volume varies with the shape of the inner circumference 332 of the cylinder 330 and the eccentricity of the roller 340. A refrigerant filled in each compression chamber 333*a*, 333*b*, and 333*c* repeatedly undergoes a series of processes in which refrigerant is suctioned, compressed, and expelled as it moves along the roller 340 and the vanes 351, 352, and 353.

This will be described hereinafter.

That is, with respect to the first compression chamber 333*a*, the volume of the first compression chamber 333*a* continuously increases until the first vane 351 passes through the intake port 334 and the second vane 352 reaches a point of completion of suction, and the refrigerant is continuously admitted from the intake port 334 to the first compression chamber 333*a*.

Next, when the second vane 352 reaches a point of completion of suction (or an angle at which refrigerant begins to be compressed), the first compression chamber 333*a* becomes sealed and moves in the direction of the exhaust ports, together with the roller 340. In this process, the volume of the first compression chamber 333*a* continuously decreases, and the refrigerant in the first compression chamber 333*a* is gradually compressed.

Next, when the first vane 351 passes the first exhaust port 335*a* and the second vane 352 does not reach the first exhaust port 335*a*, the first compression chamber 333*a* communicates with the first exhaust port 335*a* and the first exhaust valve 336*a* is opened by the pressure of the first compression chamber 333*a*. Then, a part or portion of the refrigerant in the first compression chamber 333*a* is expelled into the internal space 110 of the casing 100 through the first exhaust port 335*a*, and therefore the pressure of the first compression chamber 333*a* drops to a certain pressure. In the absence of the first exhaust port 335*a*, the refrigerant in the first compression chamber 333*a* is not expelled but moves further toward the second exhaust port 335*a* which serves as the main exhaust port.

Next, when the first vane 351 passes the second exhaust port 335*b* and the second vane 352 reaches an angle at which refrigerant begins to be expelled, the second exhaust valve 336*b* is opened by the pressure of the first compression chamber 333*a* and the refrigerant in the first compression chamber 333*a* is expelled into the internal space 110 of the casing 100 through the second exhaust port 336*b*.

The above series of processes are repeated also for the second compression chamber 333*b* between the second vane 352 and the third vane 353 and the third compression chamber 333*c* between the third vane 353 and the first vane 351. Hence, the vane rotary compressor according to this embodiment performs three exhaust strokes per rotation of the roller 340 (six exhaust strokes if including those through the first exhaust port).

The sealing surfaces of the vanes slide, while always keeping contact with the inner circumference of the cylinder, and this may lead to a large increase in mechanical loss (or friction loss) caused by friction between the cylinder and the vanes. Taking this into account, the back pressure may be lowered, but this may cause the sealing surfaces of the vanes to be separated from the inner circumference of the cylinder, thus resulting in refrigerant leakage. Particularly, in the process of a compression stroke, as the pressure in the corresponding compression chamber increases, the sealing surface of the vane slides out of the cylinder by receiving gas pressure. Then, the cylinder and the vane are spaced further apart from each other, thus increasing refrigerant leakage.

Therefore, the back pressure may be properly lowered so that the cylinder and the vane move relative to each other, spaced apart from each other, within a range where refrigerant does not leak between the inner circumference of the cylinder and the sealing surface of the vane. In this way, mechanical friction loss may be decreased, and the back pressure substantially exerted on the vanes may be secured, despite a reduction in back pressure, thereby suppressing refrigerant leakage.

In this embodiment, the vanes may have guide portions or guides that extend in the circumferential direction from two axial ends of the body portion and interlock with guide grooves to be described hereinafter to constrain an amount of projection of the vanes.

Figure 4:
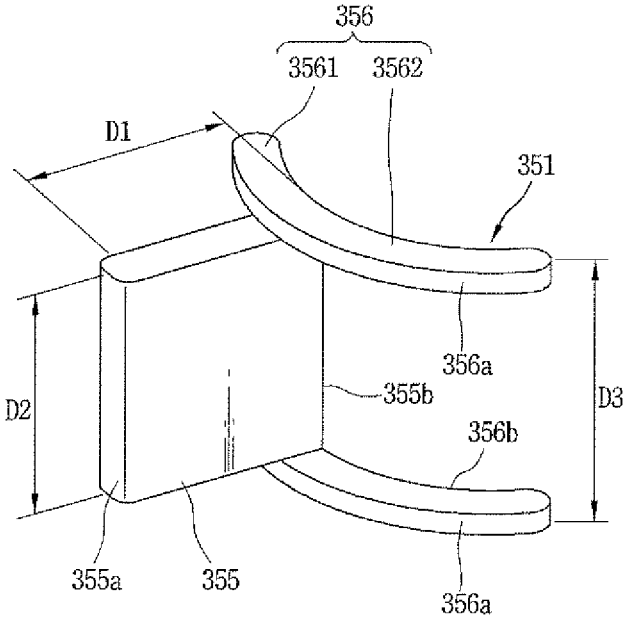
FIG. 4 is a perspective view of a vane in the vane rotary compressor of FIG. 3.
Figure 5:
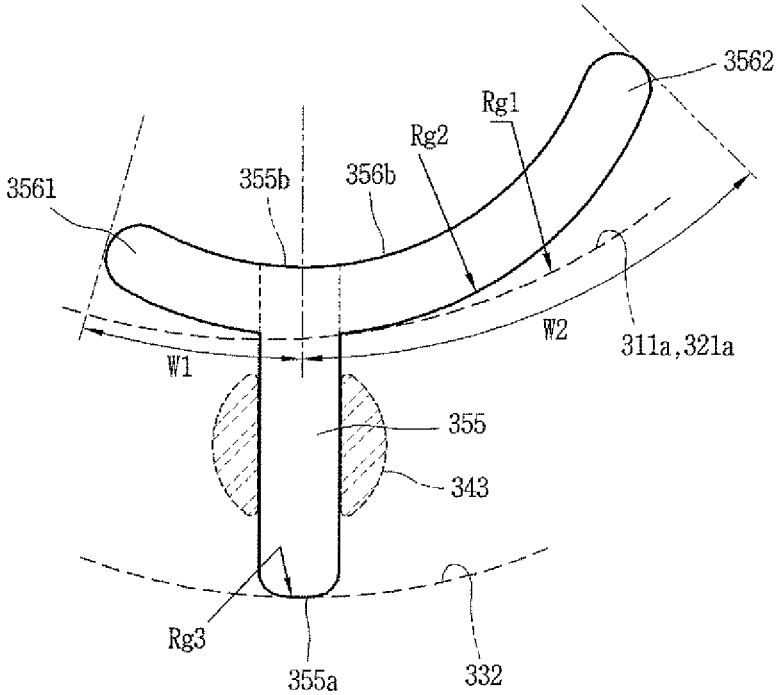
FIG. 5 is a top plan view of the vane of FIG. 4.
Figure 6:
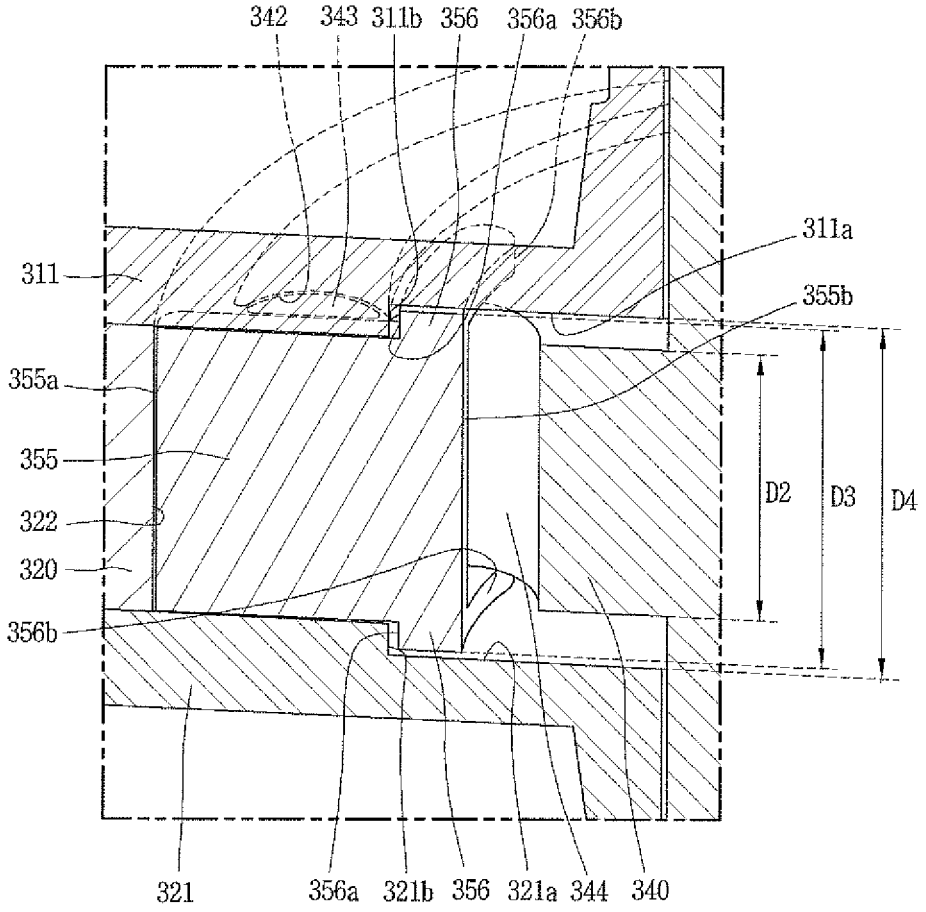
FIG. 6 is a cross-sectional view of the vane of FIG. 4 being assembled between a roller and bearings.
Figure 7:
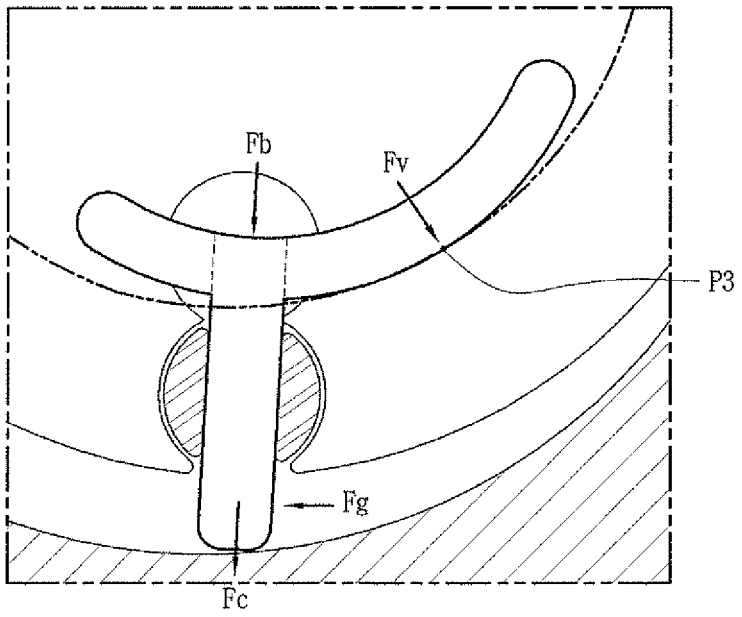
FIG. 7 is a schematic view of how force is exerted on the vane of FIG. 4.

FIG. 4 is a perspective view of a vane in the vane rotary compressor of FIG. 3. FIG. 5 is a top plan view of the vane of FIG. 4. FIG. 6 is a cross-sectional view of the vane of FIG. 4 being assembled between a roller and bearings. FIG. 7 is a schematic view of how force is exerted on the vane of FIG. 4. Hereinafter, the first vane will be described as a representative example with reference to FIGS. 4 to 6, and a detailed description thereof has been omitted as the first vane is identical to the second and third vanes.

As shown in the drawings, the first vane 351 according to this embodiment may include a body portion or body 355 having the shape of an approximate cuboid that is inserted into the swing bushing 343 and slides radially, and guide portions or guides 356 formed on two axial ends of the body portion 355 and extending in an approximate arc. Of the body portion 355, the sealing surface 355*a* corresponding to the inner circumference 332 of the cylinder 330 may be curved to correspond to the inner circumference 332 of the cylinder 330, and the first back pressure surface 355*b* contacting the back pressure chamber 344 may be made flat. The first back pressure surface 355*b*, when added together with second back pressure surfaces 356*b* of the guide portions 356, which are discussed hereinafter, has a much larger area than the sealing surface 355*a*.

A radial length D1 of the body portion 355 is a length from sliding surfaces 356*a* of the guide portions 356, which are discussed hereinafter, to the sealing surface 355*a* of the body portion 355, which may be a length at which the first vane 351 is fully inserted into the roller 340 when passing through the first contact point P1 and the sealing surface 355*a* of the first vane 351 makes contact with the inner circumference 332 of the cylinder 330 when passing through a most projecting point.

An axial length D2 of the body portion 355 may be approximately equal to the axial length of the roller 340. Thus, when the first vane 351 slides into or out of the roller 340, the two axial ends of the body portion 355 come into sliding contact with a bearing portion or bearing 311 of the main bearing 310 and a bearing portion or bearing 321 of the sub bearing 320, thereby sealing the compression chamber.

The guide portions 356 may have a shape of an arc extending to two opposite sides along a circumference from the two ends of the body portion 355. As such, the guide portions 356 may be inserted into guide grooves 311*a* and 321*a* and slide on the guide grooves 311*a* and 321*a* to restrain the body portion 355 from sliding out radially.

Although not shown, the guide portions 356 may extend to one side only along the circumference with respect to the corresponding swing bushing 343. However, in a case that the guide portions 356 extend to one side only, the first vane 351 may not be supported when it is displaced to where there is no guide portion, thus making its motion unstable. Accordingly, the guide portions 356 may extend to two opposite sides with respect to the swing bushing 343, as shown in FIGS. 4 and 5.

Also, the guide portions 356 may have sliding surfaces 356*a* whose outer circumferences of which may be radially supported by making sliding contact with inner circumferences 311*b* and 321*b* of the guide grooves 311*a* and 321*a* serving as interlocking surfaces in some part or portion (contact region) of the cylinder 330. The sliding surfaces 356*a* may be arc-shaped, and although a curvature radius Rg1 of the sliding surfaces 356*a* may be less than or equal to a minimum curvature radius Rg2 of the guide grooves 311*a* and 321*a*, the curvature radius (hereinafter, first curvature radius) Rg1 of the sliding surfaces 356*a* may be less than a minimum curvature radius (hereinafter, second curvature radius) Rg2 of the guide grooves 311*a* and 321*a* if possible, in order to prevent interference between the guide portions 356 and the guide grooves 311*a* and 321*a*.

If the first curvature radius Rg1 is greater than the second curvature radius Rg2, middle parts or portions of the guide portions 356 connected to the body portion 355 are not in contact with the guide grooves 311*a* 321*a*, but two opposite edges of the guide portions 356 make contact with the guide grooves 311*a* and 321*a*, which may cause friction. In this case, the two ends of the guide portions 356 may get farther from a center of the swing bushing 343 serving as a hinge point while the first vane 351 rotates by the swing bushing 343, thus making it difficult to maintain a distance between the first vane 351 and the cylinder 330 within an appropriate range. In a case that the first curvature radius Rg1 is greater than the second curvature radius Rg2, the two ends of the guide portions 356 may be curved by taking the friction on the two ends of the guide portions 356 into consideration.

Also, the curvature radius, that is, the first curvature radius Rg1, of the sliding surfaces 356*a* may be greater than or equal to a curvature radius (hereinafter, third curvature radius) Rg3 of the sealing surface 355*a* of the first vane 351. The first curvature radius Rg1 may be greater than the third curvature radius Rg3 if possible, in order to prevent friction between the sealing surface 355*a* of the first vane 351 and the inner circumference 332 of the cylinder 330. If the first curvature radius Rg1 is less than the third curvature radius Rg3, two opposite edges of the sealing surface 355*a* of the first vane 351 come into sliding contact with the inner circumference 332 of the cylinder 330 while the first vane 351 rotates by the swing bushing 343, which may cause friction.

Each guide portion 356 may include a first guide portion or guide 3561 and a second guide portion or guide 3562 which extend to either side, respectively, with respect to the body portion 355, but a circumferential length W1 of the first guide portion 3561 and a circumferential length W2 of the second guide portion 3562 may be different. In this case, as shown in FIG. 6, the circumferential length W2 of the second guide portion 3562, at which the first vane 351 is positioned on an electric current side with respect to a direction of movement may be longer than the circumferential length W1 of the first guide portion 3561. As such, as shown in FIG. 7, a point P3 of application of back pressure Fb against a gas pressure Fg in the compression chamber may be shifted in a direction of application of gas pressure with respect to a longitudinal centerline of the body portion 355, and this may prevent the first vane 351 supported by the swing bushing 343 from being displaced by the gas pressure and separated from the cylinder, thereby suppressing leakage among the compression chambers.

Figure 8:
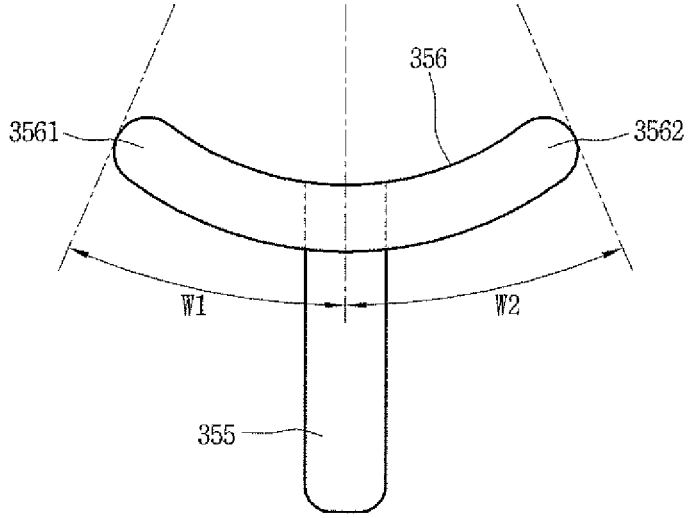
FIG. 8 is a top plan view of another embodiment of the vane of FIG. 3.

On the other hand, as shown in FIG. 8, the circumferential length W1 of the first guide portion 3561 and the circumferential length W2 of the second guide portion 3562 may be equal. FIG. 8 is a top plan view of another embodiment of the vane of FIG. 3. In this case, while the guide portions 356 are the same in overall circumferential length, neither one of the first and second guide portions 3561, 3562 is not excessively long, and the guide grooves 311*a* and 321*a* may be closer in shape to the inner circumference 322 of the cylinder 330 by that much. Due to this, the non-contact region may be wider, so overall mechanical friction may be decreased, thus leading to decreased friction loss.

The guide grooves 311*a* and 321*a* may be formed in the bearing portion 311 of the main bearing 310 contacting the roller 340 and the bearing portion 321 of the sub bearing 320. As previously explained, the guide grooves 311*a* and 321*a* may be respectively formed in the main bearing 310 and the sub bearing 320 if the guide portions 3561 and 3562 are respectively formed on the two axial ends of the body portion 355, whereas only one guide groove may be formed in either the main bearing 310 or the sub bearing 320 if a guide portion 356 of the first vane 351 is formed on only one of the two axial ends of the body portion 355.

Figure 9:
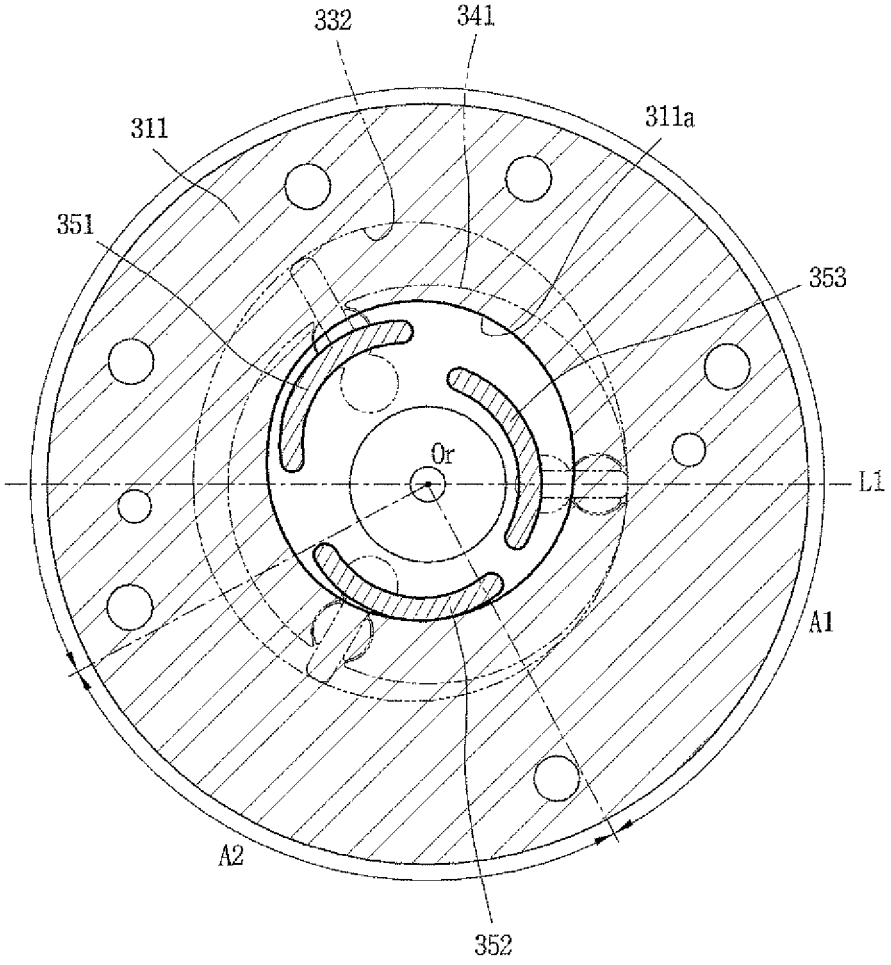
FIG. 9 is a top plan view of an example of a guide groove according to an embodiment, which is a cross-sectional view taken along the line IX-IX of a guide groove formed in a main bearing.

FIG. 9 is a top plan view of an example of a guide groove according to an embodiment, which is a cross-sectional view taken along the line IX-IX of a guide groove formed in a main bearing. FIGS. 10A-10D are top plan views illustrating a contact region and a non-contact region created as the roller rotates. As the guide groove in the main bearing and the guide groove in the sub bearing are symmetrical with respect to the roller, the guide groove in the main bearing will be described below as a representative example.

Referring to FIG. 9, the guide groove 311*a* is formed on an underside of the bearing portion 311 of the main bearing 310 which, together with a top surface of the roller 340, forms a bearing surface. Moreover, an upper side of the guide groove 311*a* with respect to the first center line L1 may be elliptical, and a lower side may be approximately circular. The guide groove 311*a* may almost correspond in shape to the inner circumference 332 of the cylinder 330 to create as large a non-contact region as possible between the vane 351 and the cylinder 332. Still, a shape of the guide groove 311*a* may be adjusted depending on a number of vanes or a shape of guide portions on the vanes.

Figure 10A:
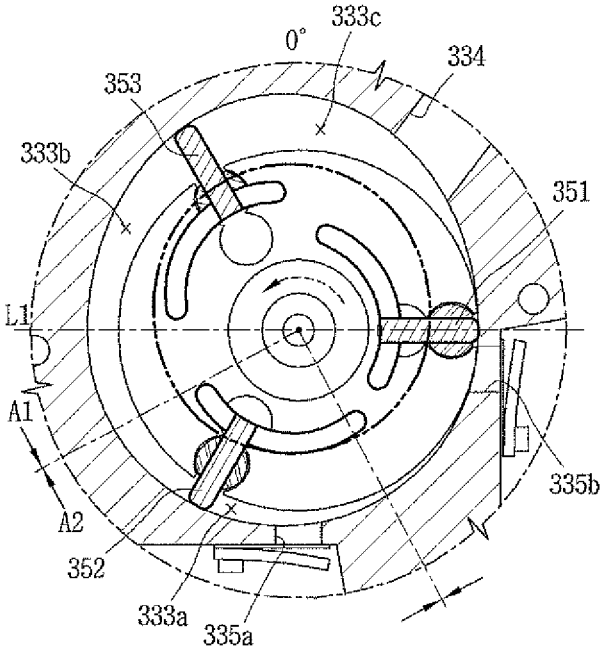
FIGS. 10A-10D are top plan views illustrating a contact region and a non-contact region created as the roller rotates.
Figure 10B:
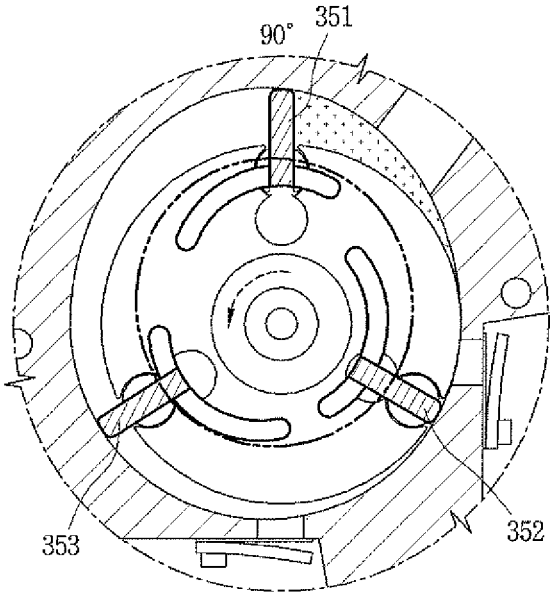
Figure 10C:
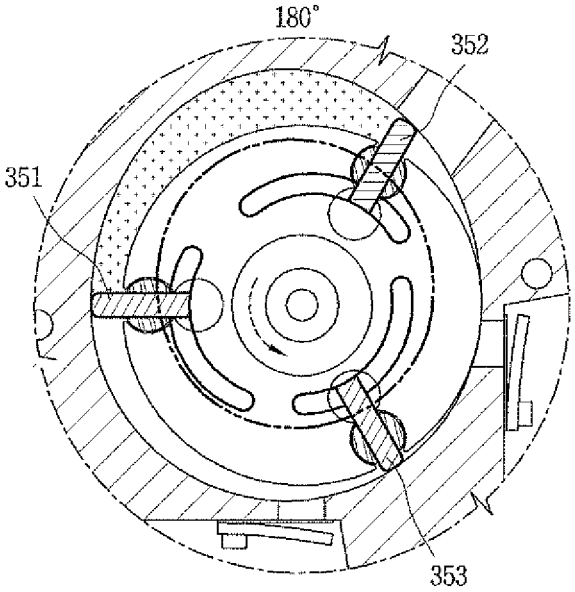

Additionally, depending on the shape, the guide groove 311*a* may have a contact region A1 in which the sealing surface of the vane and the inner circumference 332 of the cylinder 330 are in contact with each other and a non-contact region A2 in which they are separated from each other. The contact region A1 may include at least a part or portion of a region from where the corresponding compression chamber starts compressing to where it starts expelling, with respect to the direction of compression of the compression chamber, and the non-contact region A2 may include at least a part or portion of a region from where the corresponding compression chamber starts expelling to where it completes suction, with respect to the direction of compression of the compression chamber. For example, assuming that, among a plurality of vanes, first vane 351 that has passed the intake port 334 and second vane 352 positioned further downstream than the first vane 351 form first compression chamber 333*a*, the contact region A1 may be created in which the first vane 351 and the second vane 352 are in contact with the cylinder 330 while the first compression chamber 333*a* carries out an intake stroke, as shown in of FIGS. 10A-10B, and the contact region A1 may be created in which the sealing surfaces 355*a* of the first and second vanes 351 and 352 are still in contact with the inner circumference 332 of the cylinder 330 while the first compression chamber 333*a* carries out a compression stroke, as shown in FIG. 10C.

Figure 10D:
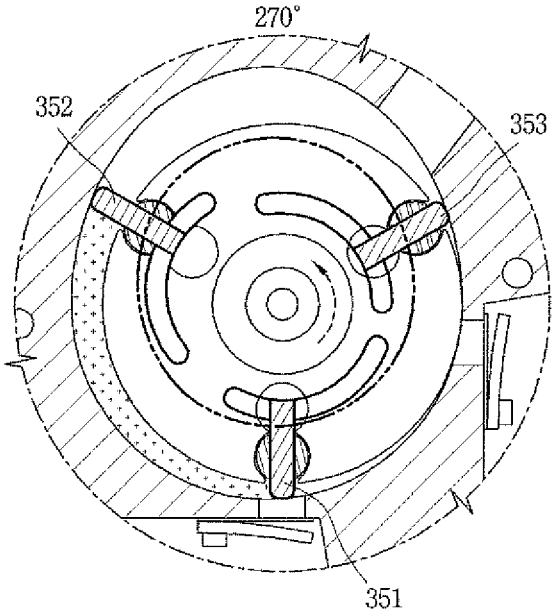

When the roller 340 rotates further and the first compression chamber 333*a* passes the first exhaust port 335*a*, as shown in FIG. 10D, a non-contact region A2 may be created in which, rather than the sealing surface of one (the first vane in the drawing) of the first and second vanes 351 and 352 being separated from the inner circumference of the cylinder, the guide portion 356 with a relatively smaller contact area is in contact with the guide groove 311*a*. The contact region and the non-contact region may be adjusted depending on the number of vanes and the length and shape of the guide portions. For example, in a case three vanes are provided as in this embodiment, the contact region A1 may be created from the end of the intake port 334 to the first centerline L1 with respect to the direction of compression, in the upper area of the first centerline L1, whereas the non-contact region A2 may be created in at least a part or portion of the lower area of the first centerline L1. That is, a region with a highest linear velocity between the vane and the cylinder may be formed as the contact region A1, and a region with a constant linear velocity between the vane and the cylinder may be formed as the non-contact region A2.

Moreover, the entire inner circumference 332 of the cylinder 330 or some part or portion of the upper area may be formed as a non-contact region. However, as a non-contact region of about intermediate level is created naturally by the intake port 334, corresponding to a range from the contact point P1 to the end of the intake port 334 which forms some part or portion of the upper area, so there may be no need to form a non-contact region corresponding to this range.

In addition, an internal area of the guide groove 311*a* may be smaller than an area of one side (that is, upper side) of the roller 340 along the axis, so the guide grooves 311*a* and 321*a* are not exposed out of the roller 340 when the roller 340 rotates. Further, an inside of the guide groove 311*a* may communicate with the back pressure chamber 344 and form a kind of back pressure space together with the back pressure chamber 344. Accordingly, the second back pressure surface 356*b* of the guide portion 356 may be positioned within the guide groove 311*a* and receives back pressure Fb within the guide groove 311*a*.

A horizontal distance t between the second sliding surface 311*b* forming the inner circumference of the guide groove 311*a* and the outer circumference of the roller 340 should be enough to maintain a minimum sealing gap.

Figure 11:
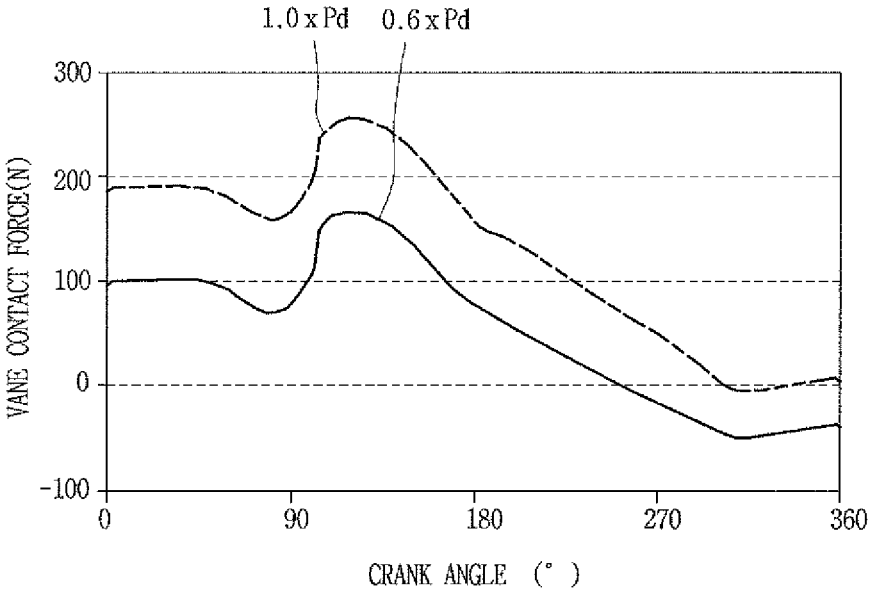
FIG. 11 is a graph showing how contact force of the vane changes relative to crank angle (angle of rotation) of the roller according to changes in back pressure, if an upper area and a lower area are defined as a contact region and a non-contact region, respectively, with respect to a first centerline according to an embodiment.

FIG. 11 is a graph showing how contact force of the vane changes relative to crank angle (angle of rotation) of the roller according to changes in back pressure, if an upper area and a lower area are defined as a contact region and a non-contact region, respectively, with respect to a first centerline according to an embodiment. 0° and 360° are contact points.

Referring to FIGS. 10A-10D and 11, a vane, for example, first vane 351, maintains a certain degree of contact force in the region from the contact point P to the intake port 334. As shown in FIGS. 10A-10D, this region is a contact region in which the sealing surface 355*a* of the first vane 351 is in contact with the inner circumference 332 of the cylinder 330 while the guide portions 356 of the first vane 351 are separated from the guide grooves 311*a* and 321*a* of the bearings 310 and 320. Accordingly, in this region, both the first and second back pressure surfaces 355*b* of the first vane 351 receive back pressure, which increases the contact force of the vane. However, as the linear velocity of the vane is low in this region, the contact force of the vane is not greatly increased but remains at a constant level. In the region (approximately from 60 to 90°) in which the first vane 351 passes the intake port 334, the contact force of the vane sharply drops temporarily due to suctioned refrigerant.

In the region (approximately from 90 to 120°) the vane 351 substantially forms the compression chamber 333*a* after passing the intake port 334, the contact force of the vane rises to the maximum value. In this region, as explained previously, both the first and second back pressure surfaces 355*b* and 356*b* of the first vane 351 receive back pressure, and at the same time, the inner circumference 332 of the cylinder 330 enters a long elliptical radius range, which causes a large increase in linear velocity between the cylinder 330 and the vane 351, That is, as the region in which the vane 351 passes through a long radius range of the cylinder 330 includes the region in which the linear velocity between the cylinder 330 and the vane 350 is highest, the contact force of the vane rises to a maximum valve in this region.

The vane's force of contact with the cylinder 330 also drops steeply after a point in time when the first vane 351 passes through a long elliptical radius range or long radius point on the inner circumference 332 of the cylinder 330. This is because, as explained previously, although both the first and second back pressure surfaces 355*b* and 256*b* of the first vane 351 receive back pressure in this region, the linear velocity between the cylinder 330 and the vane 351 decreases and at the same time the pressure in the compression chamber rises, causing an increase in repulsive force against the vane. That is, in this region, as the repulsive force against the vane increases gradually with the rise in the pressure in the compression chamber, the contact force of the vane decreases gradually.

At a point where the first vane 351 passes through the first exhaust port after passing through the first centerline, the guide portions 356 of the first vane 351 come into contact with the guide grooves 311*a* and 321*a* of the main and sub bearings, whereas the sealing surface 355*a* of the first vane 351 enters a non-contact region in which it is separated from the inner circumference 332 of the cylinder 330. Then, the contact force of the vane continuously decreases, and in some cases, drops to zero or below depending on the back pressure.

That is, in this region, as the repulsive force against the vane increases gradually with the rise in the pressure in the compression chamber, the contact force of the vane continuously decreases. Moreover, if the back pressure is lowered to about 0.6 times the discharge pressure, the pressure on the first vane 351 toward the cylinder is further reduced, resulting in a reduction of the contact force of the vane to zero or below. However, as in this embodiment, if the guides portions 356 extending in the circumferential direction are formed on both top and bottom ends of the body portion 355 of the first vane 355 and the second back pressure surfaces 356*b* are formed on the guide portions 356, the back pressure surface of the first vane 351 increases, and the force exerted on the first vane 351 toward the cylinder increases by an amount corresponding to the area of back pressure, even with the decrease in the back pressure of the back pressure chamber 344, thereby improving the contact force of the vane. Referring to FIG. 11, the contact force of the vane in this region is closer to the conventional graph line (where the back pressure is discharge pressure), as compared to the contact force of the vane at 0°.

Accordingly, mechanical friction loss occurs not on the sealing surface 355*a* of the first vane 351 but only on the guide portions 356 of the first vane 351. In this instance, the guide portions 356 of the first vane 351 make linear contact with the guide grooves 311*a* and 321*a* of the main and sub bearings, and the length of the linearly contacting surface is shorter than the length of the sealing surface 355*a* of the first vane 351. This may result in a reduction in the mechanical friction loss in this region. Moreover, in the non-contact region A2, the guide portions 356 make contact with the guide grooves 311*a* and 321*a* at a distance shorter than the sealing surface 355*a* of the vane 351, 352, and 353 with respect to the center Or of rotation of the roller 340, thereby leading to a decrease in linear velocity and a further reduction in mechanical friction loss.

Such a region with reduced contact force continues while the vane 351 forms a compression chamber, that is, from where discharging begins (approximately 270° with respect to a contact point) until the vane 351 reaches the second exhaust port 335*b* (approximately 300° to 320°) after passing the first exhaust port 335*a*. It can be seen that the contact force of the vane rises gently in a region in which the first vane 351 reaches the first contact point after passing the second exhaust port. More specifically, as the first vane 351 approaches the second exhaust port 335*b*, the pressure in the compression chamber 333*a* rises and pushes the vane 351 in a lateral direction of the swing bushing 343. Due to this, the first vane 351 is brought into close contact with the swing bushing 343, and the velocity at which the vane 351 slides backward from the swing bushing 343 slows down. Moreover, even while the first sliding surfaces 356*a* forming the guide portions 356 of the first vane 351 are separated from the second sliding surfaces 311*b* and 321*b* forming the guide grooves 311*a* and 321*a* of the two bearings 310 and 320, the contact force of the vane rises once the sealing surface 355*a* of the first vane 351 begins to make contact with the inner circumference 332 of the cylinder 330.

Figure 12A:
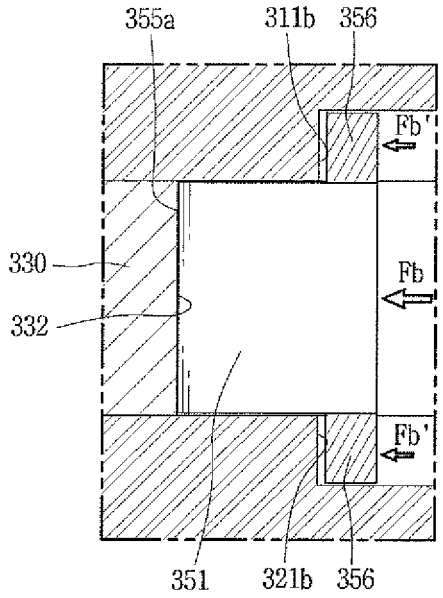
FIGS. 12A and 12B are schematic views of the contact force applied to the vane in a contact region and a non-contact region.
Figure 12B:
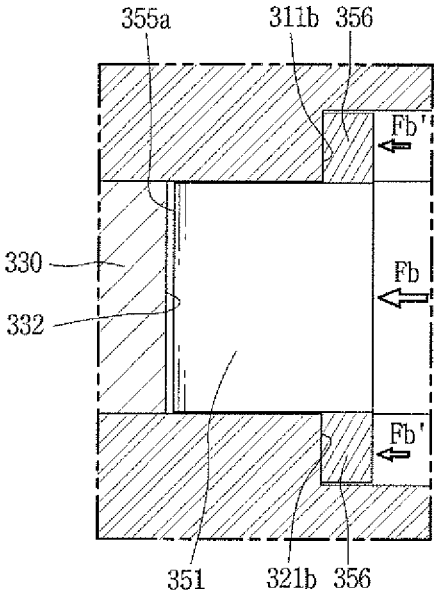

FIGS. 12A and 12B are schematic views of the contact force applied to the vane in a contact region and a non-contact region. As shown in FIG. 12A, in the contact region A1, although back pressures Fb and Fb are exerted on the first and second back pressure surfaces 355*b* and 356*b* of the vane 351, the back pressure Fb exerted on the first back pressure surface 355*b* is the main back pressure delivered to the vane 351 as the guide portions 356 of the vane are separated from the guide grooves 311*a* and 321*a* of the bearings 310 and 320. Accordingly, the substantial area of back pressure is not greatly increased although the area of back pressure of the vane 351 is increased, and if the back pressure is at an intermediate pressure level lower than discharge pressures, the contact force of the vane may be greatly lowered compared to the conventional art (where the back pressure is discharge pressure).

On the other hand, as shown in FIG. 12B, in the non-contact region, although back pressures Fb and Fb are exerted on the first and second back pressure surfaces 355*b* and 356*b* of the vane 351, the back pressure Fb' exerted on the second back pressure surface 356*b* is the main back pressure delivered to the vane 351 as the sealing surface 355*a* of the vane 351 is separated from the inner circumference 332 of the cylinder 330. However, considering that the back pressure is decreased by the amount of increase in the area of back pressure of the vane, the substantial back pressure delivered to the vane is increased, thereby improving the contact force of the vane. Still, it should be noted that the supported area of the vane is reduced to the area of the guide portions and therefore mechanical friction loss may be reduced.

In this way, in a contact region, which is some part of the entire range created by the cylinder and the vanes in a single rotation of the roller with respect to the first contact point P1 between the cylinder and the roller, the inner circumference of the cylinder and the sealing surface of the vane are in mechanical contact with each other or in contact with an oil film between them. On the other hand, in the other part, that is, a non-contact region, the inner circumference of the cylinder and the sealing surface of the vane are not in contact with each other while mechanically separated from each other keeping a sealing gap for preventing or minimizing air leakage. Therefore, overall frictional loss generated between the cylinder and the vanes may be decreased, thereby improving compressor performance.

Moreover, in the non-contact region in which the sealing surface of the vane is not in contact with the inner circumference of the cylinder, the guide portions make contact with the guide grooves at a distance shorter than the sealing surface of the vane with respect to the center of rotation of the roller. Thus, the linear velocity in the same region may be reduced, as compared to when the sealing surface of the vane is in contact with the inner circumference of the cylinder. Therefore, mechanical friction loss in the non-contact region may be further decreased.

In addition, by forming guide portions on each vane and lowering the back pressure applied to the back pressure surface of the vane to an intermediate pressure level lower than discharge pressures, even if the entire area of the back pressure surface including the guide portions is increased, the actual back pressure exerted on each vane may be lowered or maintained, or even if it is increased, the amount of increase may be very small compared to the reduction in friction loss in the non-contact region, thereby suppressing an increase in contact force of the vane in the contact region.

Meanwhile, a guide portion may be formed on either of the two axial ends of the body portion, or in some cases, may be formed on only one (the main bearing in the drawings) of the two axial ends and a guide groove may be formed only on either the main bearing or sub bearing that corresponds to the guide portion. In this case, the guide portion supporting the vane in the non-contact region is affected by a kind of eccentricity as it is formed on only one axial end, and this may make the vane's motion rather unstable but the friction loss caused by the guide portion may be reduced.

Embodiments disclosed herein provide a vane rotary compressor capable of decreasing mechanical friction loss between a cylinder and a vane by reducing the area of contact between the cylinder and the vane. Embodiments disclosed herein further provide a vane rotary compressor capable of decreasing mechanical friction loss by decreasing linear velocity by reducing the radius from the center of rotation of a roller to a contact point between members constituting a compression chamber. Embodiments disclosed herein also provide a vane rotary compressor capable of suppressing refrigerant leakage by decreasing the contact force of the vane in a region where the vane has a higher contact force and increasing the contact force of the vane in a region where the vane has a lower contact force.

Embodiments disclosed herein provide a rotary compressor in which a back pressure surface has a large area than a sealing surface of a vane and has a projection constraining portion between the vane and bearings supporting two axial ends of the vane. This may prevent refrigerant leakage by reducing the back pressure backing up the vane toward the cylinder and securing the contact force of the vane, and at the same time may reduce mechanical friction loss between the vane and the cylinder by constraining the amount of projection of the vane.

Embodiments disclosed herein provide a hermetic compressor that may include a cylinder an inner circumference of which is elliptical and forms a compression chamber; a first bearing and a second bearing provided on upper and lower sides of the cylinder and forming a compression chamber together with the cylinder; a roller that is attached to a rotary shaft supported by the first and second bearings, is eccentric to the inner circumference of the cylinder, and varies a volume of the compression chamber while rotating; and a vane that is inserted into the roller, rotates with the roller, and is pushed out toward the inner circumference of the cylinder by the rotation of the roller to divide the compression chamber into a plurality of spaces. The vane may include a body portion or body that has a sealing surface contacting the inner circumference of the cylinder and is inserted into the roller; and a guide portion or guide that extends from an axial end of the body portion in a direction crossing a direction the vane slide out, and that is slidably inserted into a guide groove formed on at least one of the first bearing or the second bearing to restrain the vane from sliding out of the roller toward the inner circumference of the cylinder in at least some part or portion of a circumference of the cylinder. The guide portion may extend from the body portion along the circumference.

The guide portion may have a sliding surface whose sealing surface side outer circumference of the vane is radially supported on the guide groove. A curvature radius of the sliding surface may be less than or equal to a minimum curvature radius of the guide groove.

An area of the sliding surface may be smaller than an area of contact between the body portion and the inner circumference of the cylinder. A height of the guide portion may be shorter than a depth of the guide groove. A maximum projecting length of the body portion may be shorter than a maximum gap between the inner circumference of the cylinder and the outer circumference of the roller.

The sealing surface of the body portion contacting the inner circumference of the cylinder may be curved with a predetermined curvature radius, and a curvature radius of the sliding surface may be greater than or equal to a curvature radius of the sealing surface of the body portion. The inner circumference of the cylinder and the inner circumference of the guide groove may be non-circular.

A swing bushing may be rotatably attached to the roller, and the body portion of the vane may be slidably attached to the swing bushing so that the vane slide in and out of the roller.

Embodiments disclosed herein provide a hermetic compressor that may include a cylinder an inner circumference of which is elliptical and forms a compression chamber, with an intake port formed at one side of the inner circumference and at least one exhaust port formed at one side of the intake port; a roller that is eccentric to the inner circumference of the cylinder and varies a volume of the compression chamber while rotating; and a plurality of vanes that is inserted into the roller, rotates with the roller, and is pushed out toward the inner circumference of the cylinder by the rotation of the roller to divide the compression chamber into a plurality of spaces. If a point at which the cylinder and the roller are closest is referred to as a contact point, an entire range of a single rotation of the roller with respect to the contact point includes a non-contact region in which the inner circumference of the cylinder and a sealing surface of a vane are separated from each other, the non-contact region including a region where a linear velocity between the cylinder and the roller is lowest. The entire range may include a contact region in which the inner circumference of the cylinder and a sealing surface of a vane are in contact with each other, the contact region including a region in which the linear velocity between the cylinder and the roller is highest.

Embodiments disclosed herein provide a hermetic compressor that may include a cylinder an inner circumference of which is circular and forms a compression chamber, with an intake port formed at one side of the inner circumference and at least one exhaust port formed at one side of the intake port; a roller that is eccentric to the inner circumference of the cylinder and varies a volume of the compression chamber while rotating; and a plurality of vanes that is inserted into the roller, rotates with the roller, and is pushed out toward the inner circumference of the cylinder by the rotation of the roller to divide the compression chamber into a plurality of spaces. If a first vane that has passed the intake port and a second vane positioned further downstream than the first vane, among the plurality of vanes, form a first compression chamber, a process for the first compression chamber to carry out an exhaust stroke may involve a non-contact region in which at least one of the first vane or the second vane is separated from the cylinder. A process for the first compression chamber to carry out a compression stroke may involve a contact region in which the first and second vanes are in contact with the cylinder.

Embodiments disclosed herein provide a hermetic compressor that may include a cylinder an inner circumference of which is circular and forms a compression chamber, with an intake port formed at one side of the inner circumference and at least one exhaust port formed at one side of the intake port; a roller that is eccentric to the inner circumference of the cylinder and varies a volume of the compression chamber while rotating; and a plurality of vanes that is inserted into the roller, rotates with the roller, and is pushed out toward the inner circumference of the cylinder by the rotation of the roller to divide the compression chamber into a plurality of spaces. If a point at which the inner circumference of the cylinder and an outer circumference of the roller are closest is referred to as a contact point and a line passing through the contact point and a center of the cylinder is referred to as a centerline, a non-contact region in which the inner circumference of the cylinder and a sealing surface of a vane are separated may be created in a region including the exhaust port with respect to the centerline. A contact region in which the inner circumference of the cylinder and a sealing surface of a vane are in contact with each other may be created in a region including the intake port with respect to the centerline.

A vane rotary compressor according to embodiments disclosed herein may improve compressor efficiency by decreasing mechanical friction loss between the cylinder and the vane as the cylinder and the vane are not in contact with each other in some part, of the range where the cylinder and the vane move relative to each other. Further, a linear velocity may be decreased as a radius from a center of rotation of a roller to a contact point between members constituting a compression chamber is reduced, and therefore mechanical friction loss in the vane may be reduced, thereby improving compressor efficiency.

Furthermore, it is possible to prevent refrigerant leakage by decreasing a back pressure backing up the vane toward the cylinder and securing a contact force of the vane and at a same time to reduce mechanical friction loss between the vane and the cylinder by constraining the amount of projection of the vane.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hermetic compressor, comprising:

a cylinder an inner circumference of which is elliptical and forms a compression chamber;

a first bearing and a second bearing provided on both sides of the cylinder and forming a compression chamber together with the cylinder;

a roller that is attached to a rotary shaft supported by the first and second bearings, eccentric to the inner circumference of the cylinder, and varies a volume of the compression chamber while rotating; and at least one vane that is inserted into the roller, rotates with the roller, and is pushed out toward the inner circumference of the cylinder by rotation of the roller to divide the compression chamber into a plurality of spaces, wherein each of the at least one vane comprises:

a vane body inserted into the roller and having a sealing surface that contacts the inner circumference of the cylinder; and a guide portion that extends from an axial end of the vane body in a direction crossing a direction the vane slides out, wherein the guide portion is slidably inserted into a guide groove formed on at least one of the first bearing or the second bearing to restrain the vane from sliding out of the roller toward the inner circumference of the cylinder, wherein when a point at which the cylinder and the roller are closest is referred to as a contact point, an entire range of a single rotation of the roller with respect to the contact point comprises a non-contact region in which the inner circumference of the cylinder and a sealing surface of the at least one vane are separated from each other, wherein the non-contact region comprises a region where a linear velocity between the cylinder and the roller is lowest, and wherein the entire range comprises a contact region in which the inner circumference of the cylinder and the sealing surface of the at least one vane are in contact with each other, the contact region comprising a region in which the linear velocity between the cylinder and the roller is highest.

2. The hermetic compressor of claim 1, wherein the guide portion extends from the vane body and along a circumference of the cylinder.

3. The hermetic compressor of claim 2, wherein the guide portion has a sliding surface which forms a sealing surface side outer circumference of the vane and which is radially supported by the guide groove, and wherein a curvature radius of the sliding surface is formed to be less than or equal to a minimum curvature radius of the guide groove.

4. The hermetic compressor of claim 3, wherein an area of the sliding surface is smaller than an area of contact between the vane body and the inner circumference of the cylinder.

5. The hermetic compressor of claim 3, wherein a height of the guide portion is shorter than a depth of the guide groove.

6. The hermetic compressor of claim 3, wherein a maximum projecting length of the vane body is shorter than a maximum gap between the inner circumference of the cylinder and an outer circumference of the roller.

7. The hermetic compressor of claim 3, wherein a sealing surface of the vane body that contacts the inner circumference of the cylinder is curved with a predetermined curvature radius, and the curvature radius of the sliding surface is greater than or equal to the curvature radius of the sealing surface of the vane body.

8. The hermetic compressor of claim 1, wherein the inner circumference of the cylinder and an inner circumference of the guide groove are non-circular.

9. The hermetic compressor of claim 1, wherein a swing bushing is rotatably attached to the roller, and the vane body of the at least one vane is slidably attached to the swing bushing so that the at least one vane slides in and out of the roller.

10. The hermetic compressor of claim 9, wherein a bushing groove is formed in a circumferential direction on an outer circumference of the roller, in which the swing bushing is rotatably attached.

11. The hermetic compressor of claim 10, wherein the swing bushing includes two substantially hemispherical bushings attached to the bushing groove of the roller, and wherein the vane body of the at least one vane is slidably attached between the two substantially hemispherical bushings in the bushing groove.

12. The hermetic compressor of claim 10, wherein a back pressure chamber is formed in the roller between the bushing groove and the rotary shaft to apply a pressure to the at least one vane by a refrigerant or oil in the back pressure chamber toward the inner circumference of the cylinder.

13. The hermetic compressor of claim 1, wherein the guide portion includes a first guide portion and a second guide portion which extend to either side, respectively, with respect to the vane body, and wherein a circumferential length of the second guide portion is longer than a circumferential length of the first guide portion with respect to a rotational direction of the roller.

14. The hermetic compressor of claim 13, wherein the guide portion includes a plurality of guide portions that extends from the vane body and along a circumference of the cylinder at an upper portion and a lower portion of the vane body.

15. The hermetic compressor of claim 14, wherein the guide portion includes a sliding surface radially supported by the guide groove, and wherein a curvature radius of the sliding surface is formed to be less than or equal to a minimum curvature radius of the guide groove.

16. The hermetic compressor of claim 15, wherein a maximum projecting length of the vane body is shorter than a maximum gap between the inner circumference of the cylinder and an outer circumference of the roller.

17. The hermetic compressor of claim 13, wherein the inner circumference of the cylinder and an inner circumference of the guide groove are non-circular.

18. A hermetic compressor, comprising:

a cylinder an inner circumference of which is circular and forms a compression chamber, wherein an intake port and at least one exhaust port are formed on the inner circumference of the cylinder;

a roller that is eccentric to the inner circumference of the cylinder and varies a volume of the compression chamber while rotating; and a plurality of vanes that is inserted into the roller, rotates with the roller, and is pushed out toward the inner circumference of the cylinder by rotation of the roller to divide the compression chamber into a plurality of spaces, wherein, when a point at which the inner circumference of the cylinder and an outer circumference of the roller are closest is referred to as a contact point and a line passing through the contact point and a center of the cylinder is referred to as a centerline, a non-contact region in which the inner circumference of the cylinder and a sealing surface of a vane of the plurality of vanes are separated is created in a region comprising the at least one exhaust port with respect to the centerline, wherein the intake port and the at least one exhaust port are formed on two opposite sides of the inner circumference of the cylinder with respect to the contact point, wherein when a first vane of the plurality of vanes having passed the intake port and a second vane of the plurality of vanes positioned further downstream than the first vane form a first compression chamber, a process for the first compression chamber to carry out an exhaust stroke involves the non-contact region in which at least one of the first vane or the second vane is separated from the cylinder, and wherein a process for the first compression chamber to carry out a compression stroke involves a contact region in which the first and second vanes are in contact with the cylinder.

19. The hermetic compressor of claim 18, wherein the contact region is created in a region comprising the intake port with respect to the centerline.

* * * * *